United States Patent [19]

Merritt et al.

[11] Patent Number: 5,057,241

[45] Date of Patent: Oct. 15, 1991

[54] DUAL POLYMER SELF-SEALING DETERGENT COMPOSITIONS AND METHODS

[75] Inventors: Colleen M. Merritt; Jerry L. Newman; David L. Shelton; Sheng-Liang Tsaur, all of Racine, Wis.

[73] Assignee: S. C. Johnson & Son, Inc., Racine, Wis.

[21] Appl. No.: 271,784

[22] Filed: Nov. 16, 1988

[51] Int. Cl.[5] ..... C11D 3/37; C11D 1/65; C11D 1/88; C11D 11/00

[52] U.S. Cl. ..... 252/174.17; 252/173; 252/174.23; 252/174.24; 252/545; 252/546; 252/550; 252/551; 252/552; 252/553; 252/554; 252/555; 252/556; 252/557; 252/558; 252/DIG. 2; 252/DIG. 5; 252/DIG. 7; 252/DIG. 14

[58] Field of Search ..... 252/DIG. 2, DIG. 5, 252/174.23, 174.17, 174.24, DIG. 14, DIG. 13, 173, 174.18

[56] References Cited

U.S. PATENT DOCUMENTS

| | | | |
|---|---|---|---|
| 1,953,413 | 4/1934 | Klarmann | 167/31 |
| 3,136,695 | 6/1964 | Tansey | 167/82 |
| 3,326,807 | 6/1967 | Guest et al. | 252/152 |
| 3,427,382 | 2/1969 | Haefele | 424/71 |
| 3,485,915 | 12/1969 | Gerstein et al. | 424/81 |
| 3,652,497 | 3/1972 | Junas et al. | 260/47 A |
| 3,719,647 | 3/1973 | Hardy et al. | 260/86.1 R |
| 3,824,190 | 7/1974 | Winicov et al. | 252/106 |
| 3,884,826 | 5/1975 | Phares, Jr. et al. | 352/106 |
| 3,962,150 | 6/1976 | Viola | 252/542 |
| 3,973,067 | 8/1976 | Newman | 428/195 |
| 4,018,363 | 4/1977 | Cassia | 222/80 |
| 4,138,381 | 2/1979 | Chang et al. | 260/29.6 TA |
| 4,146,156 | 3/1979 | Cassia | 222/181 |
| 4,149,633 | 4/1979 | Nilson | 206/219 |
| 4,210,161 | 7/1980 | Wagman | 132/7 |
| 4,214,676 | 7/1980 | Cassia | 222/83.5 |
| 4,226,736 | 10/1980 | Bush et al. | 252/135 |
| 4,243,549 | 1/1981 | Messinger et al. | 252/355 |
| 4,283,384 | 8/1981 | Jacquet et al. | 424/47 |
| 4,326,977 | 4/1982 | Schmolka | 252/106 |
| 4,351,754 | 9/1982 | Dupre | 524/445 |
| 4,364,837 | 12/1982 | Pader | 252/173 |
| 4,379,061 | 4/1983 | Rabitsch et al. | 252/174.18 |
| 4,384,096 | 5/1983 | Sonnabend | 526/313 |
| 4,421,902 | 12/1983 | Chang et al. | 526/317 |
| 4,429,097 | 1/1984 | Chang et al. | 526/317 |
| 4,429,812 | 2/1984 | Steiner et al. | 222/181 |
| 4,432,881 | 2/1984 | Evani | 252/8.5 A |
| 4,491,539 | 1/1985 | Hoskins et al. | 252/541 |
| 4,514,552 | 4/1985 | Shay et al. | 526/301 |
| 4,529,773 | 7/1985 | Witiak et al. | 524/558 |
| 4,540,507 | 9/1985 | Grollier | 252/174.23 |
| 4,552,685 | 11/1985 | Kernstock et al. | 252/355 |
| 4,556,510 | 12/1985 | Holsopple | 252/547 |
| 4,576,744 | 3/1986 | Edwards | 252/554 |
| 4,594,108 | 6/1986 | Greminger et al. | 106/170 |
| 4,617,148 | 10/1986 | Shields | 252/547 |
| 4,622,153 | 11/1986 | Watson et al. | 252/8.5 |
| 4,678,606 | 7/1987 | Akhter et al. | 252/542 |
| 4,685,931 | 8/1987 | Schieferstein et al. | 8/406 |
| 4,732,692 | 3/1988 | Zabotto et al. | 252/106 |
| 4,759,875 | 7/1988 | Hart | 252/551 |

FOREIGN PATENT DOCUMENTS

| | | |
|---|---|---|
| 0011086 | 6/1980 | European Pat. Off. . |
| 0011806 | 6/1980 | European Pat. Off. . |
| 0013836 | 8/1980 | European Pat. Off. . |
| 0870994 | 6/1961 | United Kingdom . |

OTHER PUBLICATIONS

Trademarkscan ®-Federal Database (through Dialog) on trademark Enhance ®.

Data Sheet No. CS-505 from Rohm & Haas Co. entitled: "ICS-1 Thickeners for Use in Cosmetic and Toiletry Products", Jul. 1981, 12 pages.

McCutcheon's Functional Materials, North American Edition, 1986, p. 94.

Dow Corning Corporation Data Sheet No. 22-956-83 entitled: "Information About Cosmetic Ingredients: Dow Corning ® Q2-7224 Conditioning Agent", 4 pages, 1983.

HAPPI (Household & Personal Products Industry), article by D. Witak, vol. 20, No. 2, pp. 56, 58 and 60, 1983 on Acrysol ICS-1.

*Primary Examiner*—Paul Lieberman

*Assistant Examiner*—A. Beadles-Hay

[57] ABSTRACT

Disclosed are thickened single phase detergent compositions for cleaning the body which have modified pseudoplastic characteristics because they contain a combination of two polymers which make them especially suitable for dispensing from containers which impart shear to the composition during dispensing and to methods for making such compositions. The compositions contain from about 1-20% anionic, nonionic and/or amphoteric surfactants and preferably contain anionic surfactants. The polymer imparting pseudoplastic characteristics is about 0.3 to 1.5% of an addition polymer of a $C_3$-$C_8$ alpha, beta-monoethylenically unsaturated mono- or dicarboxylic acid, at least one monoethylenically unsaturated copolymerizable monomer lacking surfactant capacity and at least one monomer possessing surfactant capacity which is the reaction product of a monoethylenically unsaturated monomer with a nonionic surfactant compound. The pseudoplastic characteristics of the addition polymer are modified by the inclusion of from about 0.05-0.3% of a water soluble cellulosic polymer rheology modifying agent which is hydroxyethyl cellulose or hydroxypropyl cellulose. The compositions are neutralized to a pH of from 5.5 to 8.5 to render the addition polymer water soluble and result in a viscosity of at least 500 centipoise at 25° C.

31 Claims, No Drawings

DUAL POLYMER SELF-SEALING DETERGENT COMPOSITIONS AND METHODS

BACKGROUND OF THE INVENTION

This invention relates to thickened single phase detergent compositions for cleaning the body which have modified pseudoplastic characteristics because they contain a combination of two polymers which make them especially suitable for dispensing from containers which impart shear to the composition during dispensing and to methods for making such compositions.

Liquid synthetic detergent compositions for use on or in conjunction with the body are typically thickened to facilitate application to the hands, face, hair, etc. Such compositions can be dispensed from squeeze bottles, pump dispensers and the like. "High shear" dispensers for liquid hand detergent compositions which are commonly found in public restrooms are exemplified in U.S. Pat. Nos. 4,018,363; 4,146,156; and 4,214,676 to Cassia; 4,149,633 to Nilson and 4,429,812 to Steiner et al. These dispensers use an elastomeric bladder coupled with a valve to dispense a measured amount of detergent to the user's hands. The detergent composition is subjected to shear as it passes through an orifice to the hands. The dispensing orifice is typically located so it points downward in the direction of the floor.

One commonly used technique for obtaining thickened detergent compositions is to add inorganic water soluble salts to detergent compositions typically containing anionic or other surfactants which increase in viscosity in the presence of such salts. While this is adequate for compositions which are poured out of bottles or squeezed out of a container which is then set upright, pump dispensers which have a downward facing orifice tend to drip or leak detergent composition after the dispenser has been actuated. This creates an unsightly condition on the area below the dispenser and can even create a safety hazard if the detergent composition drips to the floor. Another disadvantage of the use of such salts to provide viscous detergent compositions is that an osmotic gradient is created because the salts tend to absorb water which forces detergent out of the dispenser and results in undesirable post-dripping of product.

Other thickeners have been tried such as various polymers such as hydroxyalkyl celluloses such as hydroxypropyl cellulose, guar gums, polyvinyl alcohols, polycarboxy polymers and the like. For examples of such compositions, see U.S. Pat. Nos. 3,326,807 (Guest et al.); 3,485,915 (Gerstein et al.); 4,576,744 (Edwards et al.); and 4,732,692 (Zabatto et al.). The Gerstein Patent employs a combination of thickening agents composed of cellulosic polymers and neutralized carboxy polymers. These accomplish thickening of the detergent compositions without a need for inorganic salts. However, some of the high molecular weight nonionic thickeners tend to produce a thickened composition which is stringy in appearance and is somewhat slimy or unpleasant to the touch. Use of inorganic thickeners such as fumed silicas or clay gellants such as hectorite or hectorite treated with quaternized organic compounds has been suggested. However, these types of gelling agents contain particulate materials which could either clog or unduly wear the valve portions of the pump type dispensers. Another problem which arises with the use of clays or polycarboxylated polymer thickening agents is that the presence of the ionic surfactants commonly used in detergent compositions often reduces the effectiveness of the thickening agent. Not all such thickening agents are suitable for use in detergent compositions, particularly when a relatively high amount of ionic surfactant is present, e.g., more than about one percent by weight of the composition.

Furthermore, the viscosity of the composition is limited by the smallest size passage that the composition must pass through inside of the dispenser. If the viscosity is not high enough, then the composition will still continue to drip from the dispenser orifice after each use of the dispenser.

To alleviate the post-use dripping problem, certain thickeners which impart pseudoplastic properties to the detergent compositions have been employed. A polymeric thickener of the type sold by Rohm and Haas Company under the trademark ACRYSOL TM ICS-1 Thickener has been suggested for use in surfactant-containing compositions such as shampoos, see Rohm and Haas Company Data Sheet No. CS-505 entitled "ACRYSOL TM ICS-1 THICKENER FOR USE IN COSMETIC AND TOILETRY PRODUCTS", July, 1981, 12 pages. This polymer imparts pseudoplastic properties to such surfactant compositions in that in the absence of shear, the composition is relatively high in viscosity. Upon application of shear such as when the dispenser pump is actuated to force detergent composition through the dispenser orifice, the viscosity of the composition drops dramatically to permit the otherwise viscous composition to pass through the dispenser orifice to the hands. When the shearing action ceases, the composition almost immediately returns to its original high viscosity state which then eliminates post-dripping of the composition from the orifice.

Use of such polymers in pump dispensers has the disadvantage of causing the composition to splash when it is dispensed due to the above-described momentary decrease in viscosity that occurs upon dispensing. This can undesirably result in having the detergent composition splashed on the floor as well as on the user's clothes and the surrounding area.

As will be more fully described below, our invention resides in the fact that we have found that a detergent composition containing a combination of a water soluble thickening agent which imparts pseudoplastic properties to the detergent composition with a small amount of a water soluble cellulosic polymer rheology modifying agent substantially eliminates the tendency for the composition to splash upon dispensing while maintaining the viscosity of the composition at a level which substantially prevents dripping of the composition from the dispenser.

Others have suggested combinations of two or more thickening agents for use in paint compositions, cosmetics and the like. As noted above, the Gerstein '915 Patent generally teaches a combination of 0.1–5% of a neutralized carboxy polymer with 0.1–2% of hydroxypropyl cellulose as a thickening agent system for cosmetic compositions. Both of these polymers are water soluble, but it doesn't address the problem we have solved. Gerstein is directed at problems involving the use of neutralized carboxy polymers in topically applied compositions where such polymers are said to "ball up and form crumbs or pills on the skin". Inclusion of the hydroxypropyl cellulose thickener is said to alleviate this problem.

The Rohm and Haas CS-505 data sheet noted above suggests the use of ACRYSOL ICS-1 Thickener in conjunction with bentonite clay to produce a free-standing gel. This concept is further described in U.S. Pat. No. 4,351,754 to Dupre which teaches that such products are useful as air freshening gels because self-supporting, firm, high strength gels are formed although lower viscosity thickened compositions can also be formed. Our compositions do not require bentonite clays and thus avoid any problems which the presence of such solid materials might introduce to dispenser pumps.

U.S. Pat. No. 4,384,096 to Sonnabend describes liquid emulsion polymers which are believed to be similar to the ACRYSOL ICS-1 thickener and teaches their use as thickeners for aqueous coating compositions such as latex paint, for cosmetics and for drilling mud compositions. Mixtures of two or more thickeners are said to be useful in column 9, lines 31–32. It does not specifically suggest our invention.

U.S. Pat. No. 4,138,381 to Chang et al. teaches another polymeric thickener employing certain polyalkoxylated groups in the polymer chain for use in thickening coating compositions. Some of the Examples employ a combination of two thickeners: the polymeric thickener described in the '381 Patent and a "gelling agent" by the name of "Colloids 581-B". The exact nature of the latter is not described in the '381 Patent. *McCutcheon's Functional Materials*, North American Edition, 1986, page 94 describes the composition of "Colloid 581B" from Colloid, Inc. as being a "proprietary liquid" which is emulsifiable. U.S. Pat. No. 3,973,067 describes COLLOID 581B as a defoaming agent where "COLLOID" is described as a "Colloids, Inc. trademark for a dispersion of metallic soaps in emulsifiers".

U.S. Pat. No. 4,594,108 to Greminger et al. teaches highly pseudoplastic polymer solutions which comprise a water-soluble high molecular weight organic polymer which can be a cellulosic polymer or copolymers of acrylic acid and the like and a water-insoluble, but water-swellable and water dispersible polymer such as a cellulose ether like methylcellulose having relatively low amounts of methoxy substitution (i.e., less than about 18% methoxyl content). The latter polymer must be water-swellable, but not water soluble. In the '108 Patent, it is preferred that the water soluble polymeric thickener is combined with a major amount of the second water-swellable, but water-insoluble, polymer so that the combination of the two results in a more highly pseudoplastic composition than is produced by either of the polymers alone.

Our invention employs a small amount of certain cellulosic polymers as rheology modifiers to reduce the pseudoplastic effect of the thickening polymer we use to provide pseudoplastic effects to the detergent composition. The amount of rheology modifier is less than that which is typically employed to thicken the composition. Both polymers employed in our compositions are water soluble. Thus, our invention differs from that of the '108 Patent.

Dow Corning Corporation Data Sheet No. 22-956-83 entitled "Information about Cosmetic Ingredients: DOW CORNING® Q2-7224 Conditioning Agent", 4 pages, 1983 has a Formulation I: E2-7298 Conditioner which employs 0.474 weight percent ACRYSOL ICS-1 and 0.95 weight percent METHOCEL® E4M in a silicone-containing hair conditioning formulation. In this formulation, a hydroxypropyl methylcellulose is employed and its amount is far in excess of the amounts of cellulosic polymer employed in our compositions.

SUMMARY OF THE INVENTION

This invention provides thickened detergent compositions which are especially suitable for dispensing from mechanical pump dispensers because the detergent compositions are pseudoplastic. Thus, the compositions are of sufficient viscosity to be applied to the body and used for cleansing the hands, face, hair and the like. The compositions are sufficiently pseudoplastic to permit dispensing through the narrow passages present in mechanical pump dispensers, but quickly thicken to prevent dispenser post-dripping.

Our detergent compositions are aqueous compositions which contain from about 1 to 20% by weight of at least one anionic, nonionic or amphoteric surfactant. Presently preferred surfactants are anionic surfactants such as a combination of ammonium lauryl sulfate and ammonium lauryl ether sulfate which can further contain amphoterics such as cocamidopropyl betaine. The detergent compositions are single phase and uniform and are preferably clear and transparent in appearance.

These compositions are pseudoplastic because they contain from about 0.3 to 1.5% by weight of a carboxy-functional addition polymer which contains groups which have surfactant character such as polyethoxylated fatty ether groups. One presently preferred polymer is one which has the CTFA (Cosmetics, Toiletry and Fragrance Association) name of Acrylates/-Steareth-20 Methacrylate Copolymer. A sufficient amount of an alkaline neutralizing agent such as sodium hydroxide is present to neutralize the addition polymer and obtain a composition having a pH in the range of about 5.5 to 8.5, preferably from 6 to 7.2, with a viscosity that is at least about 500 centipoise at 25° C. and preferably in the range of about 600–4,000 centipoise at 25° C.

The pseudoplastic character of the addition polymer is modified by inclusion of from about 0.05 to 0.3% by weight of a water soluble cellulosic polymer rheology modifying agent which can be hydroxyethyl cellulose or hydroxypropyl cellulose. This agent modifies the characteristics of the addition polymer-thickened detergent composition so that it has little tendency to splash when dispensed from a pump dispenser.

This invention also relates to a method of making the above detergent compositions since we have found that the components of the detergent compositions of our invention are preferably added in a specific order to obtain a viscous, single phase and uniform detergent composition. Thus, the method comprises (I) charging the addition polymer with the water to form a dispersion, followed by (II) charging all of the surfactants to the aqueous dispersion previously formed, (III) dissolving the rheology modifying agent into the dipersion formed in the previous step and (IV) adding a sufficient amount of an alkaline neutralizing agent to the product of the previous step to obtain a pH in the range of about 5.5 to 8.5 and a viscosity of at least 500 centipoise at 25° C.

DETAILED DESCRIPTION OF THE INVENTION

These and other objects and advantages of the present invention are provided by a thickened modified pseudoplastic detergent composition for dispensing from a high shear dispensing unit comprising:

(a) from about 1 to 20 percent by weight of the total composition of at least one surfactant selected from the group consisting of anionic, nonionic, and amphoteric surfactants;

(b) from about 0.3 to 1.5 percent by weight of the total composition of a water soluble polymer thickening agent which when neutralized to a pH of at least 5.5 is water soluble and imparts pseudoplastic characteristics to the detergent composition and is an addition polymer prepared from monomers comprising (1) at least one $C_3$–$C_8$ alpha-beta-monoethylenically unsaturated monocarboxylic acid or dicarboxylic acid monomer having from 3 to 8 carbon atoms; (2) at least one monoethylenically unsaturated copolymerizable monomer lacking surfactant capacity, and (3) at least one monomer possessing surfactant capacity which is the reaction product of a monoethylenically unsaturated monomer with a nonionic surfactant compound wherein the monomer is copolymerizable with the monomers of (1) and (2);

(c) from about 0.05 to 0.3 percent by weight of the total composition of a water soluble cellulosic polymer rheology modifying agent selected from the group consisting of hydroxyethyl cellulose and hydroxypropyl cellulose;

(d) an effective amount of an alkaline neutralizing agent to neutralize the polymer of (b) and render the pH of the composition in the range of about 5.5 to 8.5; and (e) the balance of the composition comprising water, wherein the total of (a), (b), (c), (d) and (e) is 100% and said composition is a single phase pseudoplastic composition having a viscosity of at least about 500 centipoise at 25° C.

This invention also relates to a method for producing such compositions comprising the steps of:

(I) charging the polymer of (b) with the water to form a dispersion, followed by (II) charging all surfactant of (a) into the dispersion of Step (I) to form a dispersion, followed by (III) dissolving the water-soluble polymer rheology modifying agent of (c) in the dispersion of Step (II); and (IV) adding a sufficient amount of an alkaline neutralizing agent to the product of Step (III) to neutralize the polymer thickening agent of (b) and form a single phase composition having a pH in the range of about 5.5 to 8.5 and a viscosity of at least about 500 centipoise at 25° C., wherein the total of (a), (b), (c), (d) and (e) is 100%.

The terms "pseudoplastic" or "pseudoplastic characteristics" as used herein are intended to mean that compositions which are "pseudoplastic" exhibit a marked reduction in viscosity upon exposure to a shearing force and then recover to substantially the original viscosity shortly after the shearing force is removed. The term "single phase" is intended to mean that the composition is not an emulsion of two or more distinct phases, there is no noticeable tendency for the compositions to separate into two more separate layers upon aging and the compositions are substantially homogeneous even though a visual haziness or opacity might be present. The term "surfactant capacity" or "surfactant" is used herein in its ordinary sense meaning a compound which has surface active properties, e.g., lowers the surface tension of water, because one portion of the compound is hydrophilic and thus associates with water and other polar compounds while another portion of the compound is hydrophobic and associates with nonpolar compounds.

The surfactants useful in the compositions of the present invention are anionic, nonionic, and amphoteric surfactants of the type commonly used in detergent compositions for the body. Since the polymer used to impart pseudoplastic characteristics to these compositions is anionic by virtue of the presence of carboxy groups, cationic surfactants are best excluded from the compositions. Based on the total weight of the composition, these surfactants are present in an amount of from about 1 to 20% by weight, with from about 1 to about 5% being preferred for hand detergent compositions and 5 to 15% being preferred for hair shampoo compositions. For reasons of economy and performance, it is preferred that at least one of the surfactants present be an anionic or nonionic surfactant and more preferably, the majority (i.e., at least 50%) of the surfactants present are anionic surfactants. Other than as described above, the exact nature of the surfactants forms no part of the present invention as long as they permit single phase and uniform compositions to be formed.

Suitable anionic surfactants include sulfonated and sulfated $C_{12}$–$C_{21}$ alkyl, aralkyl and alkaryl anionic surfactants; $C_{12}$–$C_{21}$ alkyl sulfosuccinates, alkyl ether carboxylates, and N-alkoyl sarcosinates. Especially preferred are the sodium, ammonium, and the mono-, di- and triethanolamine salts of the above alkyl and aralkyl sulfates and sulfonates. The alkyl groups of the surfactants generally have a total of from about 12 to 21 carbon atoms, may be unsaturated, and are preferably fatty alkyl groups. The sulfates may be sulfate ethers containing one to ten ethylene oxide or propylene oxide units per molecule. Preferably, the sulfate ethers contain 1 to 3 ethylene oxide units.

Typical anionic surfactants include sodium lauryl sulfate, sodium oleyl sulfate, ammonium lauryl sulfate, ammonium lauryl sulfosuccinate, sodium lauryl ether sulfate, ammonium lauryl ether sulfate, sodium dodecyl benzene sulfonate, triethanolamine dodecylbenzene sulfonate and sodium N-lauroyl sarcosinate. Such surfactants are well known and are available commercially from Alcolac, Inc. of Baltimore, Md. and Stepan Company of Northfield, Ill., among others. A mild surfactant blend of the type described in U.S. Pat. No. 4,759,875 to Hart which is composed of (A) Oxo-process derived $C_{10}$–$C_{16}$ alkyl sulfates and ether sulfates such as Oxo-process derived sodium lauryl ether (2 ethylene oxide units "EO") sulfate; (B) fatty ether carboxylates such as sodium lauryl ether (10 EO) carboxylate; and (C) fatty ether sulfosuccinates such as disodium lauryl ether (3 EO) sulfosuccinate can be used where the molecular ratio of (A) to (B) is from about 5:1 to 1:1 and the molecular ratio of (B) to (C) is from about 10:1 to 1:1. The most preferred anionic surfactants are the lauryl sulfates and the lauryl ether sulfates containing from 1 to 3 ethylene oxide units per molecule, particularly ammonium, triethanolamine and sodium lauryl sulfates and lauryl ether sulfates. A presently preferred combination of anionic surfactants is a 1:1 by weight blend of ammonium lauryl sulfate with ammonium lauryl ether (1 EO) sulfate.

Metal salts of fatty acids, commonly referred to as "soaps", were not found to be useful in our compositions.

Suitable nonionic surfactants include fatty acid alkanolamides and the alkylene oxide (ethylene oxide and propylene oxide) condensates of a hydrophobic compound such as a long chain fatty acid or an alkylphenol. Typical of the fatty acid alkanolamides are those having a total of from 10 to 21 carbon atoms, such as lauric diethanolamide, coconut oil monoethanolamide and lauric isopropanolamide. The alkylene oxide condensates of long chain fatty alcohols include $C_{10}$ to $C_{21}$ fatty alcohols condensed with 3 to 20 moles of ethylene oxide, such as the ethylene oxide condensates of lauryl alcohol, myristyl alcohol and palmityl alcohol. The alkylene oxide condensates of alkylphenols include the alkylphenols having a $C_8$ to $C_{15}$ alkyl group condensed with 3 to 20 moles of ethylene oxide, such as a condensate of octylphenol having an average of about 8 ethylene oxide units per molecule and a condensate of nonylphenol having an average of about 10 ethylene oxide units per molecule. These surfactants are well known and available commercially from Alcolac, Inc., ICI Americas, Inc. of Wilmington, Del. and Thompson-Hayward Chemical Company of Kansas City, Mo., among others.

The following surfactants are often used in combination with anionic and/or nonionic surfactants because they provide foam boosting properties, impart mildness to the compositions, and foam stability as well as other desirable properties.

Amphoteric surfactants include $C_8$ to $C_{21}$ alkyl glycinates, propionates, imidazolines and amphoalkylsulfonates sold under the registered trademark of "MIRANOL" by Miranol, Inc. of Dayton, N.J. or under the tradenames "SCHERCOTERIC" and "SCHERCOZOLINE" by Scher Chemicals, Inc. of Clifton, N.J. Examples of these surfactants are cocamphoglycinate, cocamphocarboxyglycinate, lauramphocarboxyglycinate, cocamphopropionate, lauramphopropionate, stearamphoglycinate, cocamphocarboxypropionate, tallamphopropionate, tallowamphoglycinate, oleoamphoglycinate, caproamphoglycinate, caprylamphopropionate, caprylamphocarboxyglycinate, cocoyl imidazoline, lauryl imidazoline, stearyl imidazoline, behenyl imidazoline, behenyl hydroxyethyl imidazoline, caprylamphopropylsulfonate, caproamphopropylsulfonate, cocoamphopropylsulfonate, stearamphopropylsulfonate, oleamphopropylsulfonate, and the like.

Examples of amphoteric betaines and sultaines are $C_{12}$ to $C_{18}$ alkyl betaines and sultaines sold under the trademarks "MIRATAINE" by Miranol, Inc. of Dayton, N.J. and "LONZAINE" by Lonza, Inc. of Fairlawn, N.J. Examples of betaines and sultaines are cocobetaine, cocamidoethyl betaine, cocamidopropyl betaine, lauryl betaine, lauramidopropyl betaine, palmamidopropyl betaine, stearamidopropyl betaine, stearyl betaine, coco-sultaine, lauryl sultaine, tallowamidopropyl hydroxysultaine and the like. A preferred betaine for use in combination with anionic surfactants in compositions of the present invention is cocamidopropyl betaine.

Nonionic and amphoteric amine oxide surfactants include $C_{12}$ to $C_{21}$ alkyl amine and amidoamine oxides such as lauramine oxide, lauramidopropylamine oxide, cocamine oxide, cocamidopropylamine oxide, myristyl dimethylamine oxide, palmitamine oxide, palmitamidopropylamine oxide, tallow amine oxide, tallow amidopropylamine oxide, isostearamido propylamine oxide, behenamido propylamine oxide, stearamine oxide, and the like. These surfactants are well known in the art and are commercially available under the tradenames "AMMONYX" from Stepan Company and the McIntyre Chemical Company, Ltd. of Chicago, Ill., among others.

Further examples of suitable surfactants can be found in the literature such as in U.S. Pat. No. 4,364,837 to Pader which is hereby incorporated by reference.

The water soluble polymer thickening agent is used in an amount of about 0.3 to 1.5% by weight based on the total weight of the composition and more preferably is present in an amount of from about 0.5 to 1.2%. The polymer thickening agent must be one which is water soluble and imparts pseudoplastic characteristics to the detergent composition after the polymer is neutralized to a pH of 5.5 or more. Such polymer thickening agents are generally supplied in the form of an acidic aqueous emulsion or dispersion. The polymers thicken aqueous solutions when the carboxyl groups present are neutralized to a point where the pH of the solution is about 5.5 or greater. The polymeric thickening agent is an addition polymer of three components: an alpha-beta-monoethylenically unsaturated monocarboxylic acid or dicarboxylic acid of from 3 to 8 carbon atoms such as acrylic acid or methacrylic acid to provide water solubility, a monoethylenically unsaturated copolymerizable monomer lacking surfactant capacity such as methyl acrylate or ethyl acrylate to obtain the desired polymer backbone and body characteristics, and a monomer possessing surfactant capacity which provides the pseudoplastic properties to the polymer and is the reaction product of a monoethylenically unsaturated monomer with a nonionic surfactant compound wherein the monomer is copolymerizable with the foregoing monomers such as the reaction product of methacrylic acid with a monohydric nonionic surfactant to obtain a monomer such as $CH_3(CH_2)_{16}(OCH_2CH_2)_eOOCC(CH_3){=}CH_2$ where e has an average value of about 10 or 20. Optionally, up to about 2% of a polyethylenically unsaturated monomer such as ethylene glycol diacrylate or dimethacrylate or divinylbenzene can be included if a higher molecular weight polymer is desired.

Examples of such polymer thickening agents can be found in the patent literature such as in U.S. Pat. Nos. 4,384,096 (Sonnabend), 4,138,381 (Chang et al.), 4,421,902 (Chang et al.), 4,514,552 (Shay et al.) and 4,429,097 (Chang et al.) which are hereby incorporated by reference to teach such polymers. Certain such polymers are available commercially under the names ACRYSOL® ICS-1 Thickener from Rohm and Haas Company of Philadelphia, Pa. and SIPOTHIX 1941 Thickener from Alcolac, Inc. For example, ACRYSOL ICS-1 Thickener is described in the *CTFA Cosmetic Ingredient Dictionary*, Third Edition, Supplement, 1985 as being a polymer of the ester (i.e., reaction product) of methacrylic acid and Steareth-20 (q.v.) (i.e., $CH_3(CH_2)_{16}(OCH_2CH_2)_eOH$ where e has an average value of 20) and two or more monomers consisting of acrylic acid, methacrylic acid or their simple esters.

The Sonnabend '096 Patent describes a presently preferred class of polymer thickening agents which are described as liquid emulsion polymers useful as a pH responsive thickener for aqueous compositions where the polymer is stable as an aqueous colloidal dispersion at a pH lower than about 5.0 but becoming an effective thickener for aqueous systems upon adjustment to a pH of about 5.5 to 10.5 or higher. The '096 Patent polymers are composed of three components, the weight percent of each is based on the total weight of the monomers present: The first component is 15–60% of at least one $C_3$–$C_8$ alpha-beta-monoethylenically unsaturated monocarboxylic acid or dicarboxylic acid monomer, including $C_1$–$C_4$ alkyl half esters thereof if it is a dicarboxylic acid, having from 3 to 8 carbon atoms such as acrylic acid, methacrylic acid, itaconic acid, aconitic acid, maleic anhydride or maleic acid. For the purposes of our invention, acrylic and methacrylic acid are preferred and methacrylic acid is most preferred.

The second component is 15–80% of at least one copolymerizable $C_2$–$C_{12}$ alpha,beta-ethylenically unsaturated monomer selected from those of the formula $H_2C{=}CYZ$ where Y is H and Z is $-COOR^1$, $-C_6H_4R^2$, CN, Cl, $-OOCR^3$ or $-CH{=}CH_2$; Y is $CH_3$ and Z is $-COOR^1$, $-C_6H_4R^2$, CN or $-CH{=}CH_2$; or Y and Z are Cl; and $R^1$ is $C_1$–$C_8$ alkyl or $C_2$–$C_8$ hydroxyalkyl; $R^2$ is H, Cl, Br, or $C_1$–$C_4$ alkyl; and $R^3$ is $C_1$–$C_8$ alkyl. Examples of such monomers are the $C_1$–$C_8$ alkyl and $C_2$–$C_8$ hydroxyalkyl esters of acrylic and methacrylic acid such as ethyl acrylate, ethyl methacrylate, methyl methacrylate, 2-ethylhexyl acrylate, butyl acrylate, butyl methacrylate, 2-hydroxyethyl acrylate, 2-hydroxybutyl methacrylate, styrene, vinyltoluene, t-butyl styrene, vinyl acetate, acrylonitrile, methacrylonitrile, vinyl chloride and the like. For purposes of our invention, these monomers are preferably those wherein (a) Y is H and Z is $-COOR^1$, $-C_6H_4R^2$, CN, $-OOCR^3$, or $-CONH_2$; (b) Y is $C_1$–$C_4$ alkyl and Z is $-COOR^1$, $-C_6H_4R^2$, CN or $-CONH_2$; and $R^1$ is $C_1$–$C_8$ alkyl; $R^2$ is H or $C_1$–$C_4$ alkyl; and $R^3$ is $C_1$–$C_8$ alkyl. The $C_1$–$C_8$ alkyl acrylates and methacrylates such as methyl acrylate, methyl methacrylate, ethyl acrylate and butyl acrylate as well as vinyl acetate are presently most preferred.

The third component is 1–30% of a nonionic vinyl surfactant ester of the formula $H_2C{=}CR^4CO(OC_2H_4)_n(OCHR^5CH_2)_mOR^6$ wherein $R^4$ is H or $CH_3$, each $R^5$ is $C_1$–$C_2$ alkyl, $R^6$ is $C_8$–$C_{20}$ alkyl—although for our purposes, $R^6$ can be up to $C_{60}$—or $C_8$–$C_{16}$ alkylphenyl, n has an average value of from about 6–100 and m has an average value of from about 0–50 provided that n is greater than or equal to m and the sum of n+m is about 6–100. More preferably, the amount of this monomer is from 5–20%, n has an average value of 6–40, m has a value of 0–40 and the sum of n+m is about 6–80. A presently preferred monomer of this type is $R^7(OCH_2CH_2)_fOOCC(CH_3){=}CH_2$ where $R^7$ is $C_{12}$–$C_{60}$ and f has an average value of about 4 to 40. In a more preferred embodiment, $R^7$ is preferably $C_{18}$ alkyl and f is 10 to 20.

As noted above, various other addition polymers are known to impart pseudoplastic properties to aqueous solutions. The '381 Patent to Chang et al. is similar to the above, but employs an addition polymer of 10–98% of a $C_3$–$C_6$ unsaturated carboxylic acid; 1–50% of a $C_1$–$C_{30}$ alkyl acrylate or alkyl methacrylate and 1–85% of an ester of the formula $H_2C{=}CR^8COO(CH_2CHR^{10}O)_x(CH_2)_yR^9$ where $R^8$ and $R^{10}$ are hydrogen or methyl, $R^9$ is $C_1$–$C_{20}$ alkyl or $C_1$–$C_{20}$ alkylphenyl, x is 5–80, and y is 0–20. The '902 Patent to Chang et al. employs an addition polymer of at least 10% acrylic acid, methacrylic acid, itaconic acid, acryloxypropionic acid, maleic acid, fumaric acid, citraconic acid or crotonic acid; 0.5 to 25% of $H_2C{=}CHC(O)O(CH_2CH_2C(O)O)_q(CH_2CH_2O)_rR^{11}$ wherein $R^{11}$ is is selected from the group consisting of $C_8$–$C_{30}$ alkyl, alkylaryl and polycyclic alkyl groups, q has an average value of from about 0.1–10, r is at least 2 and has an average value of up to 60 or more, from zero to 50% of the $(CH_2CH_2O)_r$ units being substituted for by $(CH_2CR^{12}HO)_s$ units wherein $R^{12}$ is $C_1$–$C_2$ alkyl, and s is a number of at least 2 and has an average value of up to 60 or more; optionally, at least one ethylenically unsaturated monomer of the formula $H_2C{=}CYZ$ which is the same as the formula used in the '097 Patent to Chang et al. described below; and 0–1% of a polyethylenically unsaturated monomer. The '097 Patent to Chang et al. employs an addition polymer of at least 10% of the acid monomers described above for the '902 Patent; 0.5–30% of at least one monomer of the formula

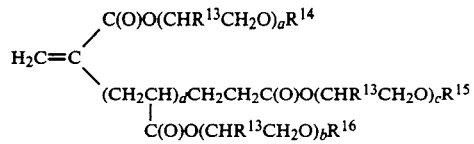

wherein $R^{14}$, $R^{15}$ and $R^{16}$, independently, are selected from the group consisting of hydrogen and alkyl, alkylaryl and polycyclic alkyl groups having 1 to 30 carbon atoms; a, b and c, independently, are zero or a number having an average value of up to 60 or more, provided that at least one of a, b or c is at least 2 and provided that the $R^{14}$, $R^{15}$ or $R^{16}$ group, when a, b or c, respectively, is at least 2, is one of said alkyl, alkylaryl and polycyclic alkyl groups having at least 8 carbon atoms, d is zero or an integer of from 1 to 5; $R^{13}$ is selected from the group consisting of hydrogen and $C_1$–$C_2$ alkyl; and the expressions $(CHR^{13}CH_2O)_a$, $(CHR^{13}CH_2O)_b$, and $(CHR^{13}CH_2O)_c$, mean that the groups $(CHR^{13}CH_2O)_a$, $(CHR^{13}CH_2O)_b$, and $(CHR^{13}CH_2O)_c$, respectively, embrace oxyethylene, oxypropylene, and oxybutylene groups arranged in any order; optionally, at least one ethylenically unsaturated monomer of the formula $H_2C{=}CYZ$ wherein (a) Y is H and Z is $-COOR^{20}$, $-C_6H_4R^{21}$, CN, Cl, $-OOCR^{22}$, $-CH{=}CH_2$ or $-CONH_2$; (b) Y is $C_1$–$C_4$ alkyl and Z is $-COOR^{20}$, $-C_6H_4R^{21}$, CN, $-CH{=}CH_2$ or $-CONH_2$; (c) Y and Z are Cl; and $R^{20}$ is $C_1$–$C_8$ alkyl or $C_2$–$C_8$ hydroxyalkyl or lower alkoxy($C_2$–$C_8$)alkyl; $R^{21}$ is H, Cl, Br, or $C_1$–$C_4$ alkyl; and $R^{22}$ is $C_1$–$C_8$ alkyl; and 0–1% of a polyethylenically unsaturated monomer. The '552 Patent to Shay et al. employs an addition polymer of 20–70% of an alpha,beta-monoethylenically unsaturated carboxylic acid; 20–80% of a monoethylenically unsaturated monomer lacking surfactant capacity, 0.5–60% of a nonionic urethane monomer which is the reaction product of a monohydric nonionic surfactant with a monethylenically unsaturated monoisocyanate; and 0–2% of a polyethylenically unsaturated monomer. In the above, all percentages are by weight and the components listed in each add up to 100%.

For thickening agents useful in the compositions of present invention, we have also found it useful to further include a small amount of a polyethylenically unsaturated cross-linking monomer such as divinylbenzene in an amount of about 0.12% although up to about 2% of such monomers may be useful.

As noted, we have found that 0.05 to 3% by weight of the total detergent composition should be a water soluble cellulosic polymer rheology modifying agent selected from the group consisting of hydroxyethyl cellulose and hydroxypropyl cellulose to modify the pseudoplastic properties imparted to the composition by reducing the tendency for the composition to splash when it is dispensed from a high shear pump dispenser.

More preferably, the amount of such modifying agent is in the range of 0.1 to 0.2%. A sufficient amount of this agent is required to reduce the tendency for such splashing to occur on exposure to a shearing force. Using more than is necessary tends to result in a somewhat stringy detergent composition which has undesirable tactile properties. Similarly, use of more than the above maximum amounts can undesirably increase the viscosity of the composition to a point where difficulty is experienced in dispensing the composition from a pump dispenser.

The types of hydroxyethyl cellulose and hydroxypropyl cellulose useful in the present invention are those which are water soluble and are commonly used as thickeners for aqueous compositions such as latex paints, cosmetics and the like. The molecular weight and viscosity must be sufficiently high to modify the pseudoplastic properties of the addition polymer thickening agent without unduly increasing the viscosity of the detergent composition and/or causing the composition to become stringy or slimy in character. Generally, hydroxyethyl cellulose and hydroxypropyl cellulose thickeners which are soluble in water at 25° C. at 1% by weight of the thickener are suitable. Such cellulosic thickeners are well known in the art and are commercially available under the tradenames "NATROSOL" and "KLUCEL® from Aqualon Company of Wilmington, Del. and "CELLOSIZE®" from Union Carbide Corporation of Danbury, Conn. Hydroxyethyl cellulose is commercially available as products containing three degrees of substitution—1.8, 2.5 and 3.0—where the "degree of substitution" refers to the average number of reactive hydroxyl groups present in each anhydrose unit in the cellulose molecule which have been reacted with ethylene oxide to produce hydroxyethyl groups on the cellulose polymer. A presently preferred modifying agent is 0.1 to 0.2% of hydroxyethyl cellulose product of degree of substitution of about 2.5 and having a viscosity of about 3,400–5,000 centipoise in water at 25° C. at 1% by weight polymer, an example of which is commercially sold as NATROSOL 250 HHR Thickener by Aqualon Company. Hydroxypropyl cellulose suitable for use in the present invention is that wherein substantially all of the primary hydroxyl groups on the cellulose have been reacted with propylene oxide and such cellulose polymers are commercially available in a variety of molecular weight ranges such as those sold by Aqualon Company under the designation "L" having a nominal average molecular weight of about 75,000 as well as "G" of molecular weight about 275,000 or "H" of molecular weight 900,000. The "L" type such as KLUCEL LF hydroxypropyl cellulose has been found to be useful in our compositions and it has a viscosity of about 5–10 centipoise at 25° C. in water at 1% by weight.

The addition polymer thickening agent must be neutralized with an alkaline neutralizing agent to enable the thickening agent to thicken the detergent composition and impart pseudoplastic characteristics to it. Neutralization can be accomplished using a volatile base such as ammonia, ammonium hydroxide, or a $C_2$–$C_{10}$ alkyl amine or $C_1$–$C_{10}$ alkanolamine such as ethylamine, hexylamine, octylamine, decylamine, monoethanolamine, diethanolamine, triethanolamine, tripropanolamine and the like, or a non-volatile inorganic base such as sodium hydroxide, potassium hydroxide, sodium carbonate and or the like. The neutralizing agents should be selected with care since some can impart an undesirable odor to the detergent composition. Potassium hydroxide, sodium hydroxide or ammonium hydroxide are presently preferred. The degree of neutralization will generally affect the viscosity of the composition. Therefore, the viscosity of the detergent composition can be controlled by the amount of neutralizing agent employed. For most detergent compositions to be dispensed from high shear pump dispensers, a viscosity of at least 500 centipoise at 25° C. and preferably in the range of about 600 to 4,000 centipoise is desirable. This viscosity is determined using a Brookfield LVF Viscosimeter from Brookfield Engineering of Tufton, Mass. using spindle #3 and 12 or 30 rpm since the pseudoplastic nature of the compositions results in different viscosities for different shear rates.

A sufficient amount of neutralizing agent can be added to bring the pH of the composition within the desired viscosity range and minimum pH of at least 5.5 without completely neutralizing all of the carboxy groups present in the addition polymer. Sufficient neutralizing agent should be employed to maintain the pH of the composition in the range of from about 5.5 to 8.5, with a maximum of about 8 being more desirable and 6.0 to 7.2 being most desirable. At pH values of greater than about 8–8.5, the detergent compositions tend to become highly alkaline and undesirable for use in conjunction with the body. Volatile bases such as ammonia undesirably tend to be released from the compositions above a pH value of about 8. The actual amount of neutralizing agent is dependent upon the amount of carboxyl groups present in the addition polymer and any other ingredients present which may also be neutralized and the degree to which the carboxyl groups are to be neutralized since less than 100% neutralization may result in a acceptable detergent composition. If more viscosity is required, then the amount of addition polymer thickening agent can be increased as is well known in the art. As will be noted below, the order of addition of ingredients and the point at which the neutralizing agent is added affect the product obtained.

The balance of the detergent composition comprises water and any other adjuvant materials commonly employed in detergent compositions for use in conjunction with the body, provided that such materials do not interact with the thickening polymer and modifying agent so as to undesirably alter the rheological properties of the composition. Examples of adjuvants are dyes, perfumes, antimicrobial agents, preservatives, anionic or nonionic conditioning or emolliency agents, pearlescing agents, and the like.

We have found that one method for preparing the compositions is the best for producing singe phase and uniform compositions which are preferably clear. Some compositions may exhibit some haziness or opacity due to the presence of ingredients which are not entirely water soluble or compatible with the remainder of the composition. As noted earlier, ingredients which cause the compositions to separate into two or more phases should be avoided.

That method is carried out by first charging the addition polymer thickening agent, which is typically supplied in the form of an acidic aqueous dispersion or emulsion, with the water to be used in the detergent composition with mixing to form a dispersion. The surfactants are then charged into that dispersion to form a further dispersion of ingredients. At this point, it is also preferable to add the adjuvant ingredients such as perfumes, dyes and the like. After these ingredients are well dispersed, the rheology modifying agent is dissolved into the dispersion of the other ingredients and mixing is continued until a homogeneous product is formed. The alkaline neutralizing agent is then added with mixing to that homogeneous product at least until the pH is 5.5 and the viscosity is at least about 500 centipoise at 25° C. To aid in dispersing the ingredients, the composition can be heated to about 100° F. (37.8° C.) during any of the steps if necessary or desirable to assist in dispersing the ingredients. Likewise, if some of the surfactants to be added are solid at room temperature, it may be advantageous to heat them to their softening or melting point to assist in dispersing them into the detergent composition being formed. Examples 26–28 and 43–44 illustrate the effect of altering the procedure for preparing the thickened modified pseudoplastic detergent compositions of the present invention.

The compositions of the present invention are useful as detergent compositions for the hands, face, body and hair, particularly where the compositions are to be dispensed from pump dispenser devices.

The following Examples are presented to better enable those skilled in the art to make and use our invention and are not to be construed as limiting the scope of the present invention to those examples alone. The scope of the present invention is properly defined by the appended claims. Unless otherwise indicated, all parts and percentages are by weight.

In the Examples, the following abbreviations and names are used:

AMPHOTERIC 1—MIRANOL® C2M Conc. from Miranol, Inc. which is 38% active cocamphocarboxyglycinate.

AMPHOTERIC 2—TEGO BETAINE L-7 from Goldschmidt Chemical Corporation of Hopewell, Va. which is 28% active cocamidopropyl betaine.

AMPHOTERIC 3—VELVETEX BK-35 from Henkel Corporation of Ambler, Pa. which is 35% active cocamidopropyl betaine.

ANIONIC 1—A 50:50 blend of ammonium lauryl sulfate and ammonium lauryl ether sulfate having an average of about 1 ethoxy unit per molecule in water at a concentration of 28% active surfactant which further contains about 0.04% KATHON® CG preservative.

ANIONIC 2—SURFINE WNT Gel from Finetex, Inc. of Elmwood Park, N.J. which contains 60% active sodium pareth-25-7 carboxylate.

ANIONIC 3—A 50:50 blend of ammonium lauryl sulfate and ammonium lauryl ether sulfate having an average of about 1 ethoxy unit per molecule in water at a nominal concentration of 22% active surfactant which further contains para-chloro-meta-xylenol antimicrobial agent at a nominal concentration of 7.15%.

BENAQUA L469 Thickener—This is organically modified magnesium montmorillonite from NL Industries, Inc. of Hightstown, N.J.

CARBOPOL® 934 Resin—Carbomer 934 from B. F. Goodrich Chemical Group of Cleveland, Ohio which is a polymer of acrylic acid cross-linked with a polyfunctional agent.

CARBOPOL® 940 Resin—Carbomer 940 from B. F. Goodrich Chemical Group of Cleveland, Ohio which is a polymer of acrylic acid cross-linked with a polyfunctional agent.

KELZAN® S Polymer—Xanthan gum which is a water dispersible high molecular weight polysaccharide from Kelco, Division of Merck & Co. of San Diego, Calif.

METHOCEL® E4M Thickener—Hydroxypropyl methylcellulose from Dow Chemical Company of Midland, Mich.

MODIFIER 1—NATROSOL 250 HHR water soluble hydroxyethyl cellulose from Aqualon Company of Wilmington, Del. having a degree of substitution of about 2.5 having a viscosity of about 3,400–5,000 centipoise in water at 25° C. at 1% by weight polymer.

MODIFIER 2—KLUCEL® LF water soluble hydroxypropyl cellulose from Aqualon Company of Wilmington, Del. having a nominal average molecular weight of about 75,000.

MODIFIER 3—A 0.1% solution of NATROSOL 250 HHR in deionized water.

NONIONIC 1—$C_9H_{19}C_6H_4(OCH_2CH_2)_nOH$ where n has an average value of about 9.5 at 100% actives level.

NONIONIC 2—AMMONYX LO from Stepan Company which is 30% active lauryl dimethyl amine oxide.

PRESERVATIVE—KATHON® CG from Rohm and Haas Company which is 5-chloro-2-methyl-4-isothiazolin-3-one.

SOAP SOLUTION—Prepared by heating 10.00 parts of EMERY® 650 (mixture of lauric and myristic acids) until it melted and separately heating to about 37.8° C. a solition of 24.00 parts of Aqueous NaOH (10%) Solution and 21.50 parts of deionized water. After the EMERY 650 had melted, it was added into the heated alkaline solution and allowed to stir until a homogeneous soap solution formed.

THICKENER 1—SIPOTHIX 1941 from Alcolac, Inc. which was an aqueous acrylic polymer emulsion containing 30% polymer having a pH of 2.5–3.5, viscosity at 25° C. of 120 centipoise (Brookfield, spindle #1, 60 rpm), density 8.75 lb/gal., and equivalent weight 218. This polymer was believed to be a polymer of the type described in the '096 Patent to Sonnabend and was believed to be an addition polymer of acrylate or methacrylate monomers containing free carboxylic acid groups, at least one acrylic acid or methacrylic acid ester and a monomer possessing surfactant capacity by virtue of the presence of a polyethoxylated nonionic surfactant group.

THICKENER 2—An aqueous acrylic emulsion polymer of an addition polymer of 12.9% ceteareth-10 methacrylate ("E5-MAA"), 42% methacrylic acid, 44.9% ethyl acrylate and 0.2% divinylbenzene which is further described in Example 13.

THICKENER 3—An aqueous acrylic emulsion polymer of an addition polymer of 12.9% ceteareth-10 methacrylate, 42% methacrylic acid, 22.45% butyl acrylate, 22.45% vinyl acetate and 0.2% divinylbenzene which is further described in Example 14.

THICKENER 4—An aqueous acrylic emulsion polymer of an addition polymer of 12.9% ceteareth-10 methacrylate, 42% methacrylic acid, 22.45% of ethyl acrylate, 22.45% of vinyl acetate and 0.2% divinylbenzene which is further described in Example 15.

UCARE® Polymer JR-30M—Modified cationic hydroxyethyl cellulose (polyquaternium-10) from Union Carbide Corporation.

VEEGUM® T Thickener—Magnesium aluminum silicate from R. T. Vanderbilt Co., Inc. of Norwalk, Conn.

EXAMPLES 1-6

These examples demonstrate the production of detergent compositions of the present invention using a variety of surfactants. Examples 5 and 6 are comparative examples. The formulations used are in Table I:

TABLE I

| | Example No.: | | | | | |
|---|---|---|---|---|---|---|
| | 1 | 2 | 3 | 4 | 5 | 6 |
| Deionized Water | 45.50 | 85.50 | 85.50 | 85.50 | 85.50 | 40.00 |
| THICKENER 1 | 3.00 | 3.00 | 3.00 | 3.00 | 3.00 | 3.00 |
| ANIONIC 1 | 50.00 | — | — | — | — | — |
| NONIONIC 1 | — | 10.00 | — | — | — | — |
| NONIONIC 2 | — | — | — | 10.00 | — | — |
| AMPHOTERIC 1 | — | — | 10.00 | — | — | — |
| AMPHOTERIC 2 | — | — | — | — | 10.00 | — |
| SOAP SOLUTION | — | — | — | — | — | 55.50 |
| MODIFIER 1 | 0.20 | 0.20 | 0.20 | 0.20 | 0.20 | 0.20 |
| Aqueous NaOH (10%) | 1.30 | 1.30 | 1.30 | 1.30 | 1.30 | 1.30 |
| Total (%) | 100.00 | 100.00 | 100.00 | 100.00 | 100.00 | 100.00 |
| Viscosity[1] | 1400 | 9000 | 7300 | 440 | 480 | — |
| pH | 6.78 | 7.20 | 8.22 | 7.80 | 6.50 | — |
| Appearance[2] | CUV | CLUV | TUV | CUV | CL/N | WP |

[1]Brookfield LVF Viscosimeter, #3 spindle, 12 rpm, 25° C. for Examples 1-3 and #3 spindle, 12 rpm, 25° C. for Examples 4-5.
[2]CUV = clear, uniform, viscous;
CLUV = cloudy, uniform, viscous
TUV = translucent, uniform, viscous;
WP = white free-standing paste Each composition was prepared by charging the THICKENER 1 into the water with mixing to form a dispersion. All of the surfactants (SOAP SOLUTION in Example 6) were then charged into that dispersion with mixing until a homogenous dispersion was formed. The powdered MODIFIER 1 was then dissolved with mixing into the dispersion formed previously and the dispersion was mixed until all of the MODIFIER 1 had dissolved. The sodium hydroxide solution was then added to the mixture of the other ingredients slowly and with stirring. The viscosity of the mixture was observed to rise as that neutralizing agent was added.

Examples 1 and 4 were clear and uniform, single phase compositions. Examples 2 and 3 were not clear, but were single phase and uniform compositions. Example 5 indicates that the betaine employed or the level of the same apparently was incompatible with the remainder of the composition and resulted in a non-uniform composition which had more than one phase. Example 6 containing soap did not produce a composition useful in the present invention and indicates that soaps are generally not useful in our compositions.

EXAMPLES 7-12

The following Examples illustrate formulations which can be used as hand and body detergent compositions. When prepared according to the method given in Examples 1-6, the compositions are clear, single phase and uniform, and are suitable for dispensing from pump dispensers. In preparing these compositions, the preservative, fragrance and dye composition were added with the dispersion of water, THICKENER 1, and surfactants. The nominal pH is in the range of 6-7.2 and the viscosity is in the range of about 600 to 4,000 centipoise at 25° C. (Brookfield LVF Viscosimeter, #3 spindle, 12 or 30 rpm). A greater or lesser amount of neutralizing agent may be added to achieve the desired viscosity and pH. The compositions exhibit a modified pseudoplastic behavior in that they are readily dispensed from a pump dispenser, but are resistant to splashing when dispensed from such a dispenser.

TABLE II

| | Example No.: | | | |
|---|---|---|---|---|
| | 7 | 8 | 9 | 10 |
| Deionized Water | 84.60975 | 73.157 | 84.35962 | 77.3594 |
| THICKENER 1 | 3.00000 | 4.000 | 3.00000 | 5.0000 |
| ANIONIC 1 | 10.00000 | 20.000 | 10.00000 | — |
| AMPHOTERIC 3 | 1.00000 | 1.000 | 1.00000 | — |
| ANIONIC 2 | — | — | — | 8.5000 |
| AMPHOTERIC 1 | — | — | — | 8.0000 |
| MODIFIER 1 | 0.20000 | 0.200 | 0.20000 | 0.1000 |
| PRESERVATIVE | 0.04000 | 0.040 | 0.04000 | 0.0400 |
| Fragrance | 0.05000 | 0.100 | 0.10000 | — |
| Dye Composition | 0.00025 | 0.003 | 0.00038 | 0.0006 |
| Aqueous NaOH (10%) | 1.10000 | 1.500 | 1.30000 | 1.0000 |
| Total (%) | 100.00000 | 100.000 | 100.00000 | 100.0000 |

Examples 7, 8 and 9 in Table II illustrate the combination of sulfate-based anionic surfactants with an amphoteric surfactant in detergent compositions of the present invention. Example 10 is an example of a composition containing a carboxylate anionic surfactant with an amphoteric surfactant.

Examples 11 and 12 are compositions containing an antimicrobial agent—para-chloro-meta-xylenol. The composition of Example 11 is: 85.0094% deionized water, 4.0000% THICKENER 1, 9.5000% ANIONIC 3, 0.1000% MODIFIER 1, 0.0400% PRESERVATIVE, 0.0500% Fragrance, 0.0006% dye composition, and 1.3000% of Aqueous NaOH (10%) solution. The composition of Example 12 is: 85.1045% deionized water, 4.000% THICKENER 1, 14.400% ANIONIC 3, 0.200% MODIFIER 1, 0.040% PRESERVATIVE, 0.0055% dyes, and 1.250% of Aqueous NaOH (10%) solution.

EXAMPLES 13-15

These Examples illustrate the use of other types of addition polymers as thickening agents. For these Examples, three addition polymer emulsions were prepared as follows.

First, a monomer containing surfactant capacity was prepared by charging 140 g of SIPONIC E5 (polyoxyethylene (10) cetyl/stearyl alcohol from Alcolac, Ltd.), 268 g of methacrylic acid, 3 g para-toluenesulfonic acid and 0.08 g of hydroquinone to a one liter, round bottom flask equipped with a stirrer and heating mantle. The contents of the flask were heated to 115° C. and maintained at that temperature for 2 hours. The contents were cooled and the reaction product (hereinafter "E5-MAA") was used in preparing the following addition polymers.

To prepare "THICKENER 2", 280 g of water and 2.0 g of sodium lauryl sulfate were charged to a round bottom flask as above. The contents of the flask were purged with nitrogen gas for 10 minutes and then the contents of the flask were heated to 80° C. A mixture of 60 g of water and 0.2 g of ammonium persulfate was prepared in a separate container ("Solution A"). In another separate container, a mixture of 13 g methacrylic acid, 27 g ethyl acrylate, 20 g E5-MAA and 0.12 g divinylbenzene was prepared ("Monomer Mix"). Six grams of the Monomer Mix were added to the stirring contents of the flask followed by all of Solution A. The contents of the flask were allowed to stir for 5 minutes and then the rest of the Monomer Mix was added to the stirring contents of the flask at 80° C. over a 40 minute period. The contents of the flask were allowed to stir for another 40 minutes after the Monomer Mix addition was completed. The product ("THICKENER 2") was cooled and filtered through a 50 micron filter. The product was a low viscosity liquid emulsion having a fine particle size with a nonvolatile solids content of 15.4%. The viscosity of an aqueous solution containing 1% nonvolatile solids content of the polymer had a viscosity of 1 centipoise at a pH of 2.8 to 6.0. The viscosity of the solution rapidly increased as the pH of the solution was increased past 6.0. The solution had a viscosity of 31,500 centipoise (Brookfield LVF Viscosimeter, #4 spindle, 6 rpm at 25° C.) at pH 7.05. The solution obtained using this thickener was pseudoplastic as evidenced by the fact that the fact that the viscosity measured at 30 rpm (i.e., at a higher shear) at pH 7.05 was only 7,400 centipoise. At any given pH level measured, the viscosity observed decreased as the shearing force (i.e., spindle rpm) was increased.

"THICKENER 3" was prepared in the same manner as was THICKENER 2 using the same ingredients, except the Monomer Mix used had the following composition: 13 g methacrylic acid, 13.5 g butyl acrylate, 13.5 g vinyl acetate, 20 g E5-MAA and 0.12 g divinylbenzene. The product ("THICKENER 3") was a low viscosity liquid emulsion having a fine particle size with a nonvolatile solids content of 13.1%. The viscosity of an aqueous solution containing 1% nonvolatile solids content of the polymer had a viscosity of 1 centipoise at a pH of 3.14 to 6.50. The viscosity of the solution rapidly increased as the pH of the solution was increased past 7.0. The solution had a viscosity of 350 centipoise (Brookfield LVF Viscosimeter, #2 spindle, 6 rpm at 25° C.) at pH 7.02 and a viscosity of 10,100 centipoise at a pH of 7.50. This polymer also imparted pseudoplastic characteristics to the solution since the viscosity at pH 7.02 using 30 rpm was 300 centipoise and the viscosity at pH 7.50 using 30 rpm was 3760.

"THICKENER 4" was prepared in the same manner as was THICKENER 2 using the same ingredients, except the Monomer Mix used had the following composition: 13 g methacrylic acid, 13.5 g ethyl acrylate, 13.5 g vinyl acetate, 20 g E5-MAA and 0.12 g divinylbenzene. The product ("THICKENER 4") was a low viscosity liquid emulsion having a fine particle size with a nonvolatile solids content of 13.7%. The viscosity of an aqueous solution containing 1% nonvolatile solids content of the polymer had a viscosity of 1 centipoise at a pH of 2.92 to less than 6.03. The viscosity of the solution rapidly increased as the pH of the solution reached 6.0. The solution had a viscosity of 30,500 centipoise (Brookfield LVF Viscosimeter, #4 spindle, 6 rpm at 25° C.) at pH 7.04. This polymer also imparted pseudoplastic characteristics to the solution since the viscosity at pH 7.02 using 30 rpm was 7,200 centipoise.

The detergent compositions prepared as Examples 13-15 had the following formulation: 82.50% deionized water, 6.0% thickener (Ex. 13=THICKENER 2, Ex. 14=THICKENER 3 and Ex. 15=THICKENER 4), 10.00% ANIONIC 1, 0.20% MODIFIER 1, and 1.30% Aqueous NaOH (10%) solution. Each Example was prepared according to the procedure described in Examples 1-6. The resulting detergent compositions were clear, single phase and uniform viscous compositions having the following characteristics:

TABLE III

| | Example No.: | | |
|---|---|---|---|
| | 13 | 14 | 15 |
| Viscosity[1] | 1400 | 9000 | 7300 |
| pH | 6.78 | 7.20 | 8.22 |

[1]Brookfield LVF Viscosimeter, #3 spindle 12 rpm, 25° C.

EXAMPLES 16-24

These examples show the effect on viscosity of increasing the level of THICKENER 1 (Examples 16, 21-23) and of increasing the pH (by adding more neutralizing agent—Examples 17-21 AND 23-24) of detergent compositions. The formulation used was 10.00% ANIONIC 1, 1.00% AMPHOTERIC 3, THICKENER 1 (per Table IV below), Aqueous NaOH (10%) Solution (per Table IV below), and balance, Deionized Water. These compositions were prepared according to the method of Examples 1-6. The viscosity listed below is reported with the spindle number used followed by the rpm used on a Brookfield LVF Viscosimeter at 25° C.

TABLE IV

| | Example No.: | | | | | | | | |
|---|---|---|---|---|---|---|---|---|---|
| | 16 | 17 | 18 | 19 | 20 | 21 | 22 | 23 | 24 |
| THICKENER 1 | 1.50 | 2.00 | 2.00 | 2.00 | 2.00 | 2.00 | 2.50 | 3.00 | 3.00 |
| Aqueous NaOH (10%) | 1.25 | 0.625 | 0.94 | 1.00 | 1.125 | 1.25 | 1.25 | 1.25 | 1.50 |
| pH | 8.40 | 6.52 | 6.74 | 6.82 | — | 7.30 | 6.85 | 6.67 | 6.94 |

TABLE IV-continued

| | Example No.: | | | | | | | | |
|---|---|---|---|---|---|---|---|---|---|
| | 16 | 17 | 18 | 19 | 20 | 21 | 22 | 23 | 24 |
| Viscosity (cps) | 82.50 | 25.00 | 57.50 | 100.00 | 775 | 1800 | 470 | 640 | 5500 |
| Spindle, rpm | 2,60 | 2,60 | 2,60 | 2,60 | 2.12 | 2,12 | 2,30 | 2,30 | 3,12 |

EXAMPLE 25

This Example demonstrates the use of hydroxypropyl cellulose as a rheology modifier in modified pseudoplastic compositions of the present invention. The following ingredients were blended in the order given as described for Examples 1-6: 84.50% Deionized Water, 3.00% THICKENER 1, 10.00% ANIONIC 1, 1.00% AMPHOTERIC 3, 0.20% MODIFIER 2, and 1.3% Aqueous NaOH (10%) Solution. The resulting detergent composition was clear, single phase and uniform having a viscosity of 2940 centipoise (#3 spindle, 30 rpm at 25° C.).

EXAMPLES 26-28

These processing Examples demonstrate the need for following a specific procedure to obtain the modified pseudoplastic detergent compositions of the present invention. Example 26 is close to the formulation of Example 9 and Examples 27 and 28 are close to the formulation of Example 11. Example 26 has slightly less MODIFIER 1 than Example 9 and these formulations contain slightly more neutralizing agent which should result in slightly more viscous detergent compositions. These are comparative examples since none produced modified pseudoplastic detergent compositions of the present invention. The formulations used are shown in Table V.

TABLE V

| | Example No.: | | |
|---|---|---|---|
| | 26 | 27 | 28 |
| MODIFIER 3 | 844.42 | 847.70 | — |
| Deionized Water-1 | — | — | 423.35 |
| THICKENER 1 | 30.00 | 40.00 | 40.00 |
| Deionized Water-2 | — | — | 423.35 |
| MODIFIER 1 | — | — | 1.00 |
| ANIONIC 1 | 100.00 | — | — |
| AMPHOTERIC 3 | 10.00 | — | — |
| ANIONIC 3 | — | 95.00 | 95.00 |
| PRESERVATIVE | 0.40 | 0.40 | 0.40 |
| Fragrance | 1.00 | 1.00 | 1.00 |
| Dye Composition | 0.38 | 0.90 | 0.90 |
| Aqueous NaOH (10%) | 13.80 | 15.00 | 15.00 |
| Total (g) | 1000.00 | 1000.00 | 1000.00 |

Examples 26 and 27 used a 0.1% solution of MODIFIER 1. The ingredients were added in the order listed above. The resulting compositions were found to be water thin in viscosity, not modified pseudoplastic compositions. Apparently, the THICKENER 1 did not perform as a thickener after the MODIFIER 1 had been allowed to hydrate in the deionized water prior to the addition of the THICKENER 1.

The composition of Example 28 was prepared in two different ways to simulate an in-line blending operation. For Example 28A, THICKENER 1 was dissolved in the Deionized Water-1 to form one solution and MODIFIER 1 was dissolved in the Deionized Water-2 to form second separate solution. These two solutions were then blended together until homogeneous followed by addition of the remaining ingredients in the order listed in Table V. Thus, neutralization with the Aqueous NaOH (10%) solution was done as the last step. The resulting product was found to be water thin in viscosity and was not a modified pseudoplastic detergent composition.

For Example 28B, separate solutions of THICKENER 1 and MODIFIER 1 were made as in Example 28A. However, the remaining ingredients were blended into the solution containing THICKENER 1 and the resulting product was neutralized with the Aqueous NaOH (10%) Solution. The last step was to add the MODIFIER 1 solution to the product formed in the previous steps. The resulting composition was found to be water thin in viscosity and was not a modified pseudoplastic detergent composition.

The resulting compositions thus differ from the compositions prepared by the method of Examples 9 and 11.

EXAMPLES 29-35

In this series of comparative Examples, various types of potential modifying agents were tried in conjunction with THICKENER 1 to determine if they could be used to form modified pseudoplastic detergent compositions. None of the materials tried were found to be useful in the compositions of the present invention.

The compositions tested were as follows: 84.50% Deionized Water, 3.00% THICKENER 1, 10.00% ANIONIC 1, 1.00% AMPHOTERIC 3, 0.20% modifying agent from Table VI, and 1.30% Aqueous NaOH (10%) Solution. The ingredients were blended in the order listed in Table VI using the method of Examples 1-6. The physical characteristics of the compositions obtained are described in Table VI.

TABLE VI

| Ex. No. | Modifying Agent | Composition Characteristics |
|---|---|---|
| 29 | UCARE ® Polymer JR-30M | Clear, lumpy appearance |
| 30 | KELZAN ® S Polymer | Cloudy, lumpy appearance |
| 31 | VEEGUM T Thickener | Cloudy, lumpy appearance |
| 32 | METHOCEL ® E4M Thickener | Clear, lumpy appearance |
| 33 | CARBOPOL ® 934 Resin | Cloudy, water thin viscosity |
| 34 | CARBOPOL ® 940 Resin | Cloudy, water thin viscosity |
| 35 | BENAQUA ® L469 Thickener | Cloudy, non-uniform |

A lumpy appearance was indicative of more than one phase being present in the composition. Such compositions also do not have desirable tactile characteristics for use as detergent compositions for the body. Neither of the cellulosic polymers tried, i.e., the cationic cellulosic used in Example 29 and the hydroxypropyl methylcellulose used in Example 32, were useful in the present invention. The cationic thickener was apparently not compatible and the hydroxypropyl methylcellulose was not sufficiently water soluble to be useful. The xanthan gum—a high molecular weight polysaccharide—used in Example 30 resulted in both a cloudy and lumpy composition. The magnesium aluminum silicate used in Example 31 likewise resulted in both a cloudy and lumpy composition. The lightly cross-linked polyacrylic acid polymer thickeners used in Examples 33 and 34 apparently interfered with the thickening properties of THICKENER 1 to result in a water thin composition with no pseudoplastic characteristics. Finally, the clay gellant used in Example 35 resulted in a composition which was cloudy and had more than one phase.

EXAMPLE 36–38

In these Examples, the viscosity of aqueous solutions of the two water soluble polymers employed to prepare the compositions of the present invention were measured. U.S. Pat. No. 4,594,108 to Greminger et al. requires two different polymers to produce a thickening composition which imparts highly pseudoplastic behavior to aqueous compositions containing the same. The major polymer employed in the '108 Patent compositions is one which is water insoluble, but water dispersible and water swellable. In column 4, line 15, footnote 3, the viscosity of one such water insoluble methylcellulose polymer was given as 25–400 cps. Footnote 3 in the same column indicates that the viscosity of a 2 percent aqueous solution of the water soluble polymer used as the minor component in the '108 Patent was 500,000 cps.

This experiment was done to show that the polymers employed in our invention differ from the polymers used in the '108 Patent since both polymers used in our composition are water soluble and can have high viscosities in aqueous compositions at 2% nonvolatile solids content. The cellulosic rheology modifying agent is water soluble and the addition polymer thickening agent is water soluble at the pH used in the detergent compositions of the present invention. The solutions prepared are shown in Table VII.

TABLE VII

| | Example No.: | | |
|---|---|---|---|
| | 36 | 37 | 38 |
| Deionized Water | 979.60 | 932.90 | 932.90 |
| MODIFIER 1 | 20.00 | — | — |
| THICKENER 1 | — | 66.70 | 66.70 |
| PRESERVATIVE | 0.40 | 0.40 | 0.40 |
| Aqueous NaOH (10%) | — | 22.69 | — |
| Total (g) | 1000.00 | 1022.69 | 1000.00 |
| pH | 6.75 | 6.21 | 3.32 |
| Viscosity (cps) | 61,000 | >100,000 | <10 |
| Spindle, rpm | 4,6 | 4,6 | 1,60 |

The results show that at the pH values used in compositions of the present invention, the polymers employed are water soluble and act as thickening agents. On the other hand, THICKENER 1 remains in its dispersed form at the pH it is supplied at and is not water soluble as evidenced by the low viscosity observed for a 2% solution of that polymer.

EXAMPLES 39–42

In these comparative Examples, the effect of using only MODIFIER 1 as the sole thickening agent in detergent compositions for pump dispensers was demonstrated. The following compositions were prepared by blending the ingredients shown in Table VIII in the order listed, starting with the Deionized Water.

TABLE VIII

| | Example No.: | | | |
|---|---|---|---|---|
| | 39 | 40 | 41 | 42 |
| Deionized Water | 89.52 | 89.27 | 89.02 | 88.77 |
| MODIFIER 1 | 0.75 | 1.00 | 1.25 | 1.50 |
| ANIONIC 3 | 9.50 | 9.50 | 9.50 | 9.50 |
| PRESERVATIVE | 0.04 | 0.04 | 0.04 | 0.04 |
| Fragrance | 0.10 | 0.10 | 0.10 | 0.10 |
| Dyes | 0.09 | 0.09 | 0.09 | 0.09 |
| Total (%) | 100.00 | 100.00 | 100.00 | 100.00 |

These compositions were placed in mechanical pump dispensing units and the manner in which each composition was dispensed was observed. Example 39 was judged to be too thin in viscosity and splashed upon dispensing. Example 40 was still a little too thin in viscosity and splashing was still noticeable. Example 41 was observed to flow well with minimal tendency to splash and was retained in the hand after dispensing, however, there was some splashing noted and the composition did exhibit post-dripping from the dispenser as well as some stringiness and slimness to the touch. Example 42 was found to flow slowly from the dispenser and was too viscous. It was also judged as being slimy and hard to rinse from the hands.

EXAMPLES 43–44

These Examples demonstrate an alternative, but less preferred, method for making the compositions of the present invention. It involves making a thickened, neutralized detergent composition using all of the ingredients except the rheology modifying agent which is added last to the thickened composition. It was somewhat difficult to disperse the rheology modifying agent into the thickened compositions and was not as advantageous as the method of Examples 1–6.

In Example 43, a thickened intermediate hereinafter "INTERMEDIATE A" was prepared by mixing the following together in the order given: 84.479625% Deionized Water, 3.00% THICKENER 1, 10.00% ANIONIC 1, 1.00% AMPHOTERIC 3, 0.04% PRESERVATIVE, 0.10% perfume, 0.000375% dye composition and 1.38% Aqueous NaOH (10% ) solution. The amounts of INTERMEDIATE A and MODIFIER 1 listed in Table IX were used to prepare laboratory batches of detergent compositions by sifting the powdered MODIFIER 1 into the INTERMEDIATE A with good agitation of the INTERMEDIATE a and agitation was continued for an additional hour at ambient temperature. Some MODIFIER 1 was noted on the sides of the beaker in which the compositions were prepared. The compositions were placed in dispensers and evaluated as in Examples 39–42. The results are reported in Table IX.

Example 44 was prepared in the same manner as Example 43 using the following "INTERMEDIATE B" formulation: 84.8590% Deionized Water, 4.00% THICKENER 1, 9.50% ANIONIC 3, 0.04% PRESERVATIVE, 0.10% perfume, 0.0009% dye composition and 1.50% Aqueous NaOH (10%) solution. The results are reported in Table IX.

TABLE IX

| Ex. No. | INTERMEDIATE | MODIFIER 1 | Results |
|---|---|---|---|
| 43A | 99.95% | 0.05% | Splash into hands quite prevalent |
| 43B | 99.90% | 0.10% | Splash into hands quite prevalent |
| 43C | 99.85% | 0.15% | Product stayed in cupped hands |
| 43D | 99.80 | 0.20% | Product stayed in cupped hands |
| 44A | 99.95 | 0.05% | Splash into hands quite prevalent |
| 44B | 99.90% | 0.10% | Product stayed in cupped hand |
| 44C | 99.85% | 0.15% | Product stayed in cupped hand |
| 44D | 99 80% | 0.20% | Product stayed in hand, slightly stringy |
| 44E | 99.70% | 0.30% | Product stayed in hand, slightly stringy |

Some MODIFIER 1 was lost in this method since it was difficult to disperse the powder into the thickened composition. However, it did appear that for this formulation, compositions containing about 0.1–0.2% MODIFIER 1 had a minimal tendency to splash and feel slimy upon dispensing compared with the other amounts of MODIFIER 1 tested.

That which is claimed is:

1. A thickened modified pseudoplastic detergent composition for dispensing from a high shear dispensing unit comprising:

(a) from about 1 to 20 percent by weight of the total composition of at least one surfactant selected from the group consisting of anionic, nonionic, and amphoteric surfactants;

(b) from about 0.3 to 1.5 percent by weight of the total composition of a water soluble polymer thickening agent which when neutralized to a pH of at least 5.5 is water soluble and imparts pseudoplastic characteristics to the detergent composition and is an addition polymer prepared from monomers comprising (1) at least one $C_3$–$C_8$ alpha-beta-monoethylenically unsaturated monocarboxylic acid or dicarboxylic acid monomer having from 3 to 8 carbon atoms; (2) at least one monoethylenically unsaturated copolymerizable monomer lacking surfactant capacity, and (3) at least one monomer possessing surfactant capacity which is the reaction product of a monoethylenically unsaturated monomer with a nonionic surfactant compound wherein the monomer is copolymerizable with the monomers of (1) and (2);

(c) from about 0.05 to 0.3 percent by weight of the total composition of a water soluble cellulosic polymer rheology modifying agent selected from the group consisting of hydroxyethyl cellulose and hydroxypropyl cellulose;

(d) an effective amount of an alkaline neutralizing agent to neutralize the polymer of (b) and render the pH of the composition in the range of about 5.5 to 8.5; and (e) the balance of the composition comprising water, wherein the total of (a), (b), (c), (d) and (e) is 100% and said composition is a single phase pseudoplastic composition having a viscosity of at least about 500 centipoise at 25° C.

2. The composition as claimed in claim 1 wherein the surfactant includes at least one anionic surfactant selected from the group consisting of sulfonated and sulfated $C_{12}$–$C_{21}$ alkyl, aralkyl and alkaryl anionic surfactants, $C_{12}$–$C_{21}$ alkyl sulfosuccinates, alkyl ether carboxylates and N-alkoyl sarcosinates.

3. The composition as claimed in claim 2 where the acid monomer (1) is selected from the group consisting of acrylic acid or methacrylic acid and the monomer (2) is selected from copolymerizable monomers of the formula $H_2C{=}CYZ$ wherein (a) Y is H and Z is $-COOR^1$, $-C_6H_4R^2$, CN, $-OOCR^3$, or $-CONH_2$; (b) Y is $C_1$–$C_4$ alkyl and Z is $-COOR^1$, $-C_6H_4R^2$, CN or $-CONH_2$; and $R^1$ is $C_1$–$C_8$ alkyl; $R^2$ is H or $C_1$–$C_4$ alkyl; and $R^3$ is $C_1$–$C_8$ alkyl.

4. The composition as claimed in claim 3 where (b) comprises from (i) about 30–60% of monomer (1); (ii) about 15–80% of monomer (2); and (iii) about 5–20% of a surfactant ester of the formula $H_2C{=}CR^4CO(OC_2H_4)_n(OCHR^5CH_2)_mOR^6$ wherein $R^4$ is H or $CH_3$, each $R^5$ is $C_1$–$C_2$ alkyl, $R^6$ is $C_8$–$C_{60}$ alkyl or $C_8$–$C_{16}$ alkylphenyl, n has an average value of from about 6–40 and m has an average value of from about 0–40 provided that n is greater than or equal to m and the sum of n+m is about 6–80.

5. The composition as claimed in claim 4 which contains from 0.1% to 0.2% of the modifying agent (c).

6. The composition as claimed in claim 5 wherein (c) is a hydroxyethyl cellulose polymer having a degree of substitution of about 2.5.

7. The composition of claim 2 wherein the surfactant (a) is at least 50% anionic surfactant and further includes an amphoteric surfactant selected from the group consisting of $C_8$–$C_{21}$ alkyl glycinates and propionates and $C_{12}$–$C_{18}$ alkyl betaines.

8. The composition of claim 6 wherein the surfactant (a) is at least 50% anionic surfactant and further includes an amphoteric surfactant selected from the group consisting of $C_8$–$C_{21}$ alkyl glycinates and propionates and $C_{12}$–$C_{18}$ alkyl betaines.

9. A thickened modified pseudoplastic detergent composition for dispensing from a high shear dispensing unit comprising:

(a) from about 1 to 20 percent by weight of the total composition of at least one surfactant selected from the group consisting of anionic, nonionic, and amphoteric surfactants, at least about 50% by weight of of the total weight of surfactant present being anionic, the anionic surfactant being at least one surfactant selected from the group consisting of sulfonated and sulfated $C_{12}$–$C_{21}$ alkyl, aralkyl and alkaryl anionic surfactants, $C_{12}$–$C_{21}$ alkyl sulfosuccinates, alkyl ether carboxylates and N-alkoyl sarcosinates;

(b) from about 0.9 to 1.2 percent by weight of the total composition of a water soluble polymer thickening agent which when neutralized to a pH of at least 5.5 is water soluble and imparts pseudoplastic characteristics to the detergent composition and is an addition polymer prepared from monomers comprising (1) from about 15–60% by weight of the total monomers of at least one $C_3$–$C_8$ alpha-beta-monoethylenically unsaturated monocarboxylic acid or dicarboxylic acid monomer having from 3 to 8 carbon atoms; (2) from about 15–80% by weight of the total monomers of at least one monoethylenically unsaturated copolymerizable monomer lacking surfactant capacity, and (3) from about 1–30% by weight of the total monomers of a surfactant ester of the formula $H_2C{=}CR^4CO(OC_2H_4)_n(OCHR^5CH_2)_mOR^6$ wherein $R^4$ is H or $CH_3$, each $R^5$ is $C_1$–$C_2$ alkyl, $R^6$ is $C_8$–$C_{60}$ alkyl or $C_8$–$C_{16}$ alkylphenyl, n has an average value of from about 6–40 and m has an average value of from about 0–40 provided that n is greater than or equal to m and the sum of n+m is about 6–80, and (4) from 0–2% of a polyethylenically unsaturated monomer, with the total of (1), (2), (3) and (4) being 100%;

(c) from about 0.1 to 0.2 percent by weight of the total composition of a water soluble cellulosic polymer rheology modifying agent selected from the group consisting of hydroxyethyl cellulose and hydroxypropyl cellulose;

(d) an effective amount of an alkaline neutralizing agent to neutralize the polymer of (b) and render the pH of the composition in the range of about 5.5 to 8.5; and (e) the balance of the composition comprising water, wherein the total of (a), (b), (c), (d) and (e) is 100% and said composition is a single phase pseudoplastic composition having a viscosity of at least about 500 centipoise at 25° C.

10. The composition as claimed in claim 9 where monomer (1) is selected from the group consisting of acrylic acid and methacrylic acid; monomer (2) is selected from the group consisting of $C_1$–$C_8$ alkyl acrylates and methacrylates and vinyl acetate; and monomer (3) is selected from surfactant monomers of the formula $R^7(OCH_2CH_2)_fOOCC(CH_3){=}CH_2$ where $R^7$ is $C_{12}$ to $C_{60}$ alkyl and f has an average value of about 4 to 40.

11. The composition as claimed in claim 10 wherein (a) is selected from the group consisting of sodium, ammonium, and the mono-, di- and triethanolamine salts of $C_{12}$–$C_{21}$ alkyl and aralkyl sulfates and sulfonates and $C_{12}$–$C_{21}$ alkyl ether carboxylates and the pH is in the range of from about 6 to 7.2.

12. The composition as claimed in claim 11 wherein the surfactant (a) is a blend of of lauryl sulfate and lauryl ether sulfate containing from 1 to 4 ethylene oxide units per molecule and optionally further includes at least one $C_{12}$–$C_{18}$ alkyl betaine.

13. The composition as claimed in claim 10 wherein modifying agent (c) is a hydroxyethyl cellulose having a degree of substitution of about 2.5.

14. A method of making a thickened modified pseudoplastic detergent composition for dispensing from a high shear dispensing unit comprising (a) from about 1 to 20 percent by weight of the total composition of at least one surfactant selected from the group consisting of anionic, nonionic and amphoteric surfactants; (b) from about 0.3 to 1.5 percent by weight of the total composition of a water soluble polymer thickening agent which when neutralized to a pH of at least 5.5 is water soluble and imparts pseudoplastic characteristics to the detergent composition and is an addition polymer prepared from monomers comprising (1) at least one $C_3$–$C_8$ alpha-beta-monoethylenically unsaturated monocarboxylic acid or dicarboxylic acid monomer having from 3 to 8 carbon atoms; (2) of at least one monoethylenically unsaturated copolymerizable monomer lacking surfactant capacity, and (3) at least one monomer possessing surfactant capacity which is the reaction product of a monoethylenically unsaturated monomer with a nonionic surfactant compound wherein the monomer is copolymerizable with the monomers of (1) and (2); (c) from about 0.05 to 0.3 percent by weight of the total composition of a water soluble cellulosic polymer rheology modifying agent selected from the group consisting of hydroxyethyl cellulose and hydroxypropyl cellulose; (d) an effective amount of an alkaline neutralizing agent to neutralize the polymer of (b) and render the pH of the composition in the range of about 5.5 to 8.5; and (e) the balance of the composition comprising water, said method comprising the steps of:

(I) charging the polymer of (b) with the water to form a dispersion, followed by (II) charging all surfactant of (a) into the dispersion of Step (I) to form a dispersion, followed by (III) dissolving the water-soluble polymer rheology modifying agent of (c) in the dispersion of Step (II); and (IV) adding a sufficient amount of an alkaline neutralizing agent to the product of Step (III) to neutralize the polymer thickening agent of (b) and form a single phase composition having a pH in the range of about 5.5 to 8.5 and a viscosity of at least about 500 centipoise at 25° C., wherein the total of (a), (b), (c), (d) and (e) is 100%.

15. The method as claimed in claim 14 wherein the surfactant includes at least one anionic surfactant selected from the group consisting of sulfonated and sulfated $C_{12}$–$C_{21}$ alkyl, aralkyl and alkaryl anionic surfactants, $C_{12}$–$C_{21}$ alkyl sulfosuccinates, alkyl ether carboxylates and N-alkoyl sarcosinates.

16. The method as claimed in claim 15 where acid monomer (1) is selected from the group consisting of acrylic acid or methacrylic acid and the monomer (2) lacking surfactant capacity is selected from copolymerizable monomers of the formula $H_2C{=}CYZ$ wherein (a) Y is H and Z is $-COOR^1$, $-C_6H_4R^2$, CN, $-OOCR^3$, or $-CONH_2$; (b) Y is $C_1$–$C_4$ alkyl and Z is $-COOR^1$, $-C_6H_4R^2$, CN or $-CONH_2$; and $R^1$ is $C_1$–$C_8$ alkyl; $R^2$ is H or $C_1$–$C_4$ alkyl; and $R^3$ is $C_1$–$C_8$ alkyl.

17. The method as claimed in claim 16 where (b) comprises from (i) about 30–60% of monomer (1); (ii) about 15–80% of monomer (2); and (iii) from 5–20% of a surfactant ester of the formula $H_2C{=}CR^4CO(OC_2H_4)_n(OCHR^5CH_2)_mOR^6$ wherein $R^4$ is H or $CH_3$, each $R^5$ is $C_1$–$C_2$ alkyl, $R^6$ is $C_8$–$C_{60}$ alkyl or $C_8$–$C_{16}$ alkylphenyl, n has an average value of from about 6–40 and m has an average value of from about 0–40 provided that n is greater than or equal to m and the sum of n+m is about 6–80.

18. The method as claimed in claim 17 which contains from 0.1% to 0.2% of the modifying agent (c).

19. The method as claimed in claim 18 wherein (c) is a hydroxyethyl cellulose polymer having a degree of substitution of about 2.5.

20. The method as claimed in claim 15 wherein the surfactant (a) is at least 50% anionic surfactant and further includes an amphoteric surfactant selected from the group consisting of $C_8$–$C_{21}$ alkyl glycinates and propionates and $C_{12}$–$C_{18}$ alkyl betaines.

21. The method as claimed in claim 19 wherein the surfactant (a) is at least 50% anionic surfactant and further includes an amphoteric surfactant selected from the group consisting of $C_8$–$C_{21}$ alkyl glycinates and propionates and $C_{12}$–$C_{18}$ alkyl betaines.

22. A method of modifying a thickened pseudoplastic detergent composition for dispensing from a high shear dispensing unit comprising including (a) from about 0.05 to 0.3 percent by weight of the total composition of a water soluble cellulosic polymer rheology modifying agent selected from the group consisting of hydroxyethyl cellulose and hydroxypropyl cellulose as part of the composition which further comprises (b) from about 1 to 20 percent by weight of the total composition of at least one surfactant selected from the group consisting of anionic, nonionic, and amphoteric surfactants;

(c) from about 0.3 to 1.5 percent by weight of the total composition of a water soluble polymer thickening agent which when neutralized to a pH of at least 5.5 is water soluble and imparts pseudoplastic characteristics to the detergent composition and is an addition polymer prepared from monomers comprising (1) at least one $C_3$–$C_8$ alpha-beta-monoethylenically unsaturated monocarboxylic acid or dicarboxylic acid monomer having from 3 to 8 carbon atoms; (2) at least one monoethylenically unsaturated copolymerizable monomer lacking surfactant capacity, and (3) at least one monomer possessing surfactant capacity which is the reaction product of a monoethylenically unsaturated monomer with a nonionic surfactant compound wherein the monomer is copolymerizable with the monomers of (1) and (2);

(d) an effective amount of alkaline neutralizing agent to neutralize the polymer of (c) and render the pH of the composition in the range of about 5.5 to 8.5; and (e) the balance of the composition comprising water, wherein the total of (a), (b), (c), (d) and (e) is 100% and said composition is a single phase pseudoplastic composition having a viscosity of at least about 500 centipoise at 25° C.

23. The method as claimed in claim 22 wherein from 0.1% to 0.2% of the modifying agent (a) is included.

24. The method as claimed in claim 23 wherein (a) is a hydroxyethyl cellulose polymer having a degree of substitution of about 2.5.

25. The method of claim 24 wherein the surfactant (b) is at least 50% anionic surfactant and further includes an amphoteric surfactant selected from the group consisting of $C_8$–$C_{21}$ alkyl glycinates and propionates and $C_{12}$–$C_{18}$ alkyl betaines.

26. The method as claimed in claim 22 wherein the surfactant includes at least one anionic surfactant selected from the group consisting of sulfonated and sulfated $C_{12}$–$C_{21}$ alkyl, aralkyl and alkaryl anionic surfactants, $C_{12}$–$C_{21}$ alkyl sulfosuccinates, alkyl ether carboxylates and N-alkoyl sarcosinates.

27. The method of claim 26 wherein the surfactant (b) is at least 50% anionic surfactant and further includes an amphoteric surfactant selected from the group consisting of $C_8$–$C_{21}$ alkyl glycinates and propionates and $C_{21}$–$C_{18}$ alkyl betaines.

28. The method as claimed in claim 26 where the acid monomer (1) is selected from the group consisting of acrylic acid or methacrylic acid and the monomer (2) is selected from copolymerizable monomers of the formula $H_2C{=}CYZ$ wherein (a) Y is H and Z is $-COOR^1$, $-C_6H_4R^2$, $-CN$, $-OOCR^3$, or $-CONH_2$; (b) Y is $C_1$–$C_4$ alkyl and Z is $-COOR^1$, $-C_6H_4R^2$, $-CN$ or $-CONH_2$; and $R^1$ is $C_1$–$C_8$ alkyl; $R^2$ is H or $C_1$–$C_4$ alkyl; and $R^3$ is $C_1$–$C_8$ alkyl.

29. The method as claimed in claim 27 where (c) comprises from (i) about 30–60% of monomer (1); (ii) about 15–80% of monomer (2); and (iii) about 5–20% of a surfactant ester of the formula $H_2C{=}CR^4CO(OC_2H_4)_n(OCHR^5CH_2)_mOR^6$ wherein $R^4$ is H or $CH_3$, each $R^5$ is $C_1$–$C_2$ alkyl, $R^6$ is $C_8$–$C_{60}$ alkyl or $C_8$–$C_{16}$ alkylphenyl, n has an average value of from about 6–40 and m has an average value of from about 0–40 provided that n is greater than or equal to m and the sum of n+m is about 6–80.

30. The method as claimed in claim 29 wherein from 0.1% to 0.2% of the modifying agent (a) is included.

31. The method as claimed in claim 30 wherein (a) is a hydroxyethyl cellulose polymer having a degree of substitution of about 2.5.

* * * * *

UNITED STATES PATENT AND TRADEMARK OFFICE

CERTIFICATE OF CORRECTION

PATENT NO. : 5,057,241

DATED : October 15, 1991

INVENTOR(S) : Colleen M. Merritt et al.

It is certified that error appears in the above-identified patent and that said Letters Patent is hereby corrected as shown below:

In column 24, line 62, the duplicate word "of" should be deleted.

In column 28, line 21, "$C_{21}$-$C_{18}$" should be -- $C_{12}$-$C_{18}$ --.

Signed and Sealed this

Ninth Day of March, 1993

*Attest:*

STEPHEN G. KUNIN

*Attesting Officer*

*Acting Commissioner of Patents and Trademarks*